US008708208B2

(12) United States Patent
Long

(10) Patent No.: US 8,708,208 B2
(45) Date of Patent: Apr. 29, 2014

(54) APPARATUS AND METHOD FOR SEPARATING DUNNAGE FROM A PALLET

(76) Inventor: Donald Long, Millington, MI (US)

( * ) Notice: Subject to any disclaimer, the term of this patent is extended or adjusted under 35 U.S.C. 154(b) by 549 days.

(21) Appl. No.: 12/959,788

(22) Filed: Dec. 3, 2010

(65) Prior Publication Data

US 2012/0138652 A1 Jun. 7, 2012

(51) Int. Cl.
*B26F 3/02* (2006.01)

(52) U.S. Cl.
USPC ..... 225/1; 225/91

(58) Field of Classification Search
USPC ..... 83/613; 225/1, 91; 214/620, 750, 621, 214/350
See application file for complete search history.

(56) References Cited

U.S. PATENT DOCUMENTS 3,556,328 A * 1/1971 Miles et al. ..... 414/607
3,791,544 A * 2/1974 Moses ..... 414/607
4,669,949 A * 6/1987 Sutton ..... 414/814

* cited by examiner

*Primary Examiner* — Ghassem Alie
(74) *Attorney, Agent, or Firm* — The Weintraub Group, P.L.C.

(57) ABSTRACT

An apparatus for separating dunnage from a pallet including a base plate for placement on a floor, a shearing surface positioned at a predetermined distance above the base plate, and means for securing the shearing surface to the base plate. The shearing surface includes a bottom edge which is substantially planar with the base plate. The base plate, bottom edge of the shearing surface, and the means for securing define an opening for passing a pallet therethrough. In a second aspect, a method is provided for separating dunnage from a pallet which includes providing the apparatus, and forcing the pallet through the opening, whereby the shearing surface separates the dunnage from the pallet when the pallet passes through the opening.

12 Claims, 4 Drawing Sheets

APPARATUS AND METHOD FOR SEPARATING DUNNAGE FROM A PALLET

BACKGROUND OF THE INVENTION

1. Field of the Invention

The present invention pertains to an apparatus and method for separating dunnage from a pallet. More particularly, the present invention pertains to an apparatus and method for separating dunnage from a pallet in which the pallet is forced through an opening thereby separating the dunnage from the pallet.

2. Description of the Prior Art

As a result of environmental and economical factors, it has become desirable for companies to minimize the waste which they deposit into landfills. It is known that some particular types of businesses, such as those involved in the manufacturing or distribution of goods, may be prone to generating significant amounts of waste in the typical operation of business.

As part of this objective to minimize or eliminate the depositing of waste into landfills, some companies have committed to converting at least a portion of their facilities to "landfill-free" status. That is, these companies have set forth the goal in which no waste from any designated "landfill-free" facility will end up in a landfill. In order to accomplish this goal, the waste must either be reused or recycled, which in turn requires it to be properly sorted and organized. It is further understood that some articles of waste include more than one category of waste material, and therefore it is necessary to disassemble these articles before sorting can take place.

In particular, this is the case with dunnage that is attached atop a pallet. As understood by one having ordinary skill in the art, dunnage includes cardboard boxes or any other similar type of packaging material that is secured atop a pallet during transportation. This is a common way in which to package and transport goods for delivery to and from manufacturing and distributing facilities. The dunnage is secured atop the pallet, which is most often made from wood, although it can be made from plastic materials as well. The dunnage is typically secured atop the pallet using fasteners such as heavy duty staples, adhesives, or the like. As described above, the dunnage must be removed from the pallet before the dunnage and pallet can be sorted for recycling or reusing.

The dunnage and pallet are designed to be secured to each other sufficiently so that the dunnage remains secured to the pallet during transportation. Packaging engineers presumably did not contemplate that it would be desirable to separate the dunnage from the pallet, and that both the dunnage and the pallet would simply be thrown away after use.

Accordingly, the dunnage is not easily removed from the pallet for sorting. There are no specialized tools for performing this task, and it is often accomplished by simply ripping the dunnage off of the pallet using one's hands or whatever reasonable tool is available, such as a pry bar or a shovel. As a result, this activity can be dangerous for the employees responsible and inefficient for the company as well.

Because the concept of a landfill-free facility is relatively new, the problem of safely and efficiently removing dunnage from a pallet is believed to be previously unknown. Therefore, it is not known of any previous attempts in the prior art to solve this problem.

The present invention, as is detailed hereinbelow, seeks to solve this problem by providing an apparatus and method for separating dunnage from a pallet in which the pallet is forced through an opening thereby separating the dunnage from the pallet.

SUMMARY OF THE INVENTION

In a first embodiment hereof, the present invention provides an apparatus for separating dunnage from a pallet which generally comprises: (a) a base plate for placement on a floor; (b) a shearing surface positioned at a predetermined distance above the base plate, the shearing surface having a bottom edge which is substantially planar with the base plate; and (c) means for securing the shearing surface to the base plate.

In a second aspect hereof, the present invention also is directed to a method for separating dunnage from a pallet which generally comprises: (a) providing a shearing apparatus including a base plate and a shearing surface, the shearing surface being positioned above the base plate, the base plate and the shearing surface defining an opening therebetween; and (b) forcing the pallet through the opening, whereby the shearing surface separates the dunnage from the pallet when the pallet passes through the opening.

For a more complete understanding of the present invention, reference is made to the following detailed description and accompanying drawings. In the drawings, like reference characters refer to like parts throughout the views in which:

DETAILED DESCRIPTION OF THE PREFERRED EMBODIMENT

At the outset it is to be noted that dunnage D as described in the ensuing disclosure is to be understood by one having ordinary skill in the art as being any type of disposable packaging material for transporting goods atop a pallet P. Dunnage D can comprise a box, a bag, or similar retaining mechanism, and can be formed from any suitable material such as cardboard, plastic, or the like.

Figure 1:
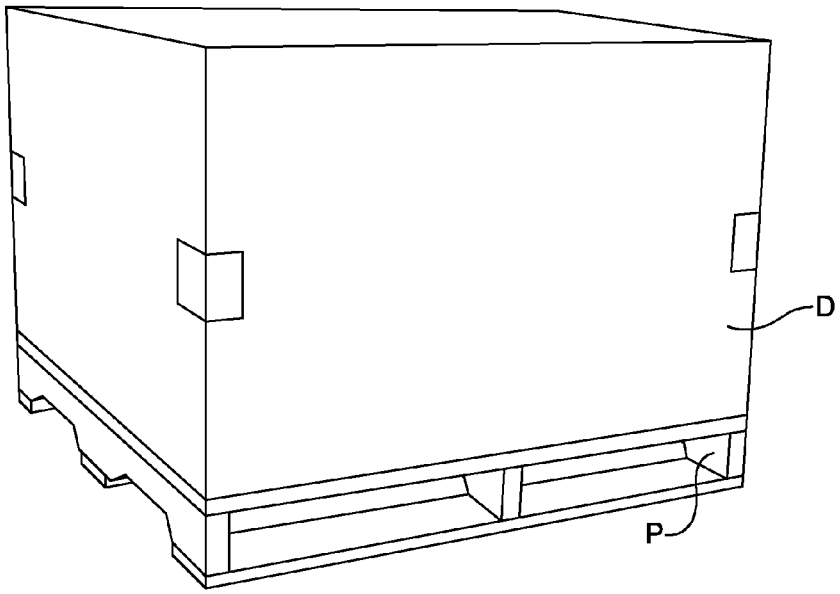
FIG. 1 is a perspective view of an exemplary dunnage and pallet contemplated for use with the present invention.

Furthermore, a pallet P as described in the ensuing disclosure is to be understood by one having ordinary skill in the art as being any type of platform which can be engaged by a forklift and which is suitable for securing articles atop. The pallet P can comprise a plurality of wooden boards secured to each other, a plastic molded platform capable of receiving the forks of a forklift, and so forth. An exemplary dunnage D and pallet P as contemplated for use herewith is shown in FIG. 1.

Figure 2:
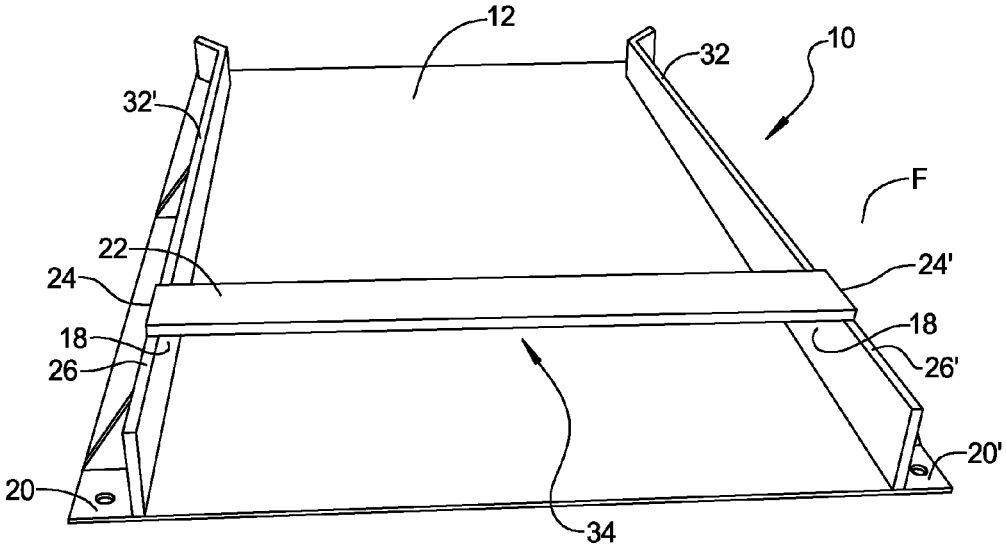
FIG. 2 is a perspective view of a first embodiment of the present invention hereof.

In accordance with the present invention and as shown generally in FIG. 2, there is provided an apparatus 10 which generally comprises: (a) a base plate 12 for placement on the floor F; (b) a shearing surface 14 positioned at a predetermined distance above the base plate 12, the shearing surface 14 having a bottom edge 16 which is substantially planar with the base plate 12; and (c) means for securing 18 the shearing surface 14 to the base plate 12.

With more particularity, the base plate 12 comprises a planar plate which is preferably generally rectangular in shape and has a pair of opposed sides 20,20'. It is relatively thin such that it can be driven upon by a forklift, yet sufficiently strong to perform the shearing operation described below. Preferably the base plate 12 is about ⅜" inch thick and formed from a metal such as steel. Even more preferably, the base plate 12 is formed a grade of steel suitable for use as a floor plate, for instance ASTM A786. The base plate 12 is sufficiently wide to allow the apparatus 10 to accept any typical width of pallets which are available. The base plate 12 can optionally include a traction surface (not shown), such as a diamond pattern, to increase traction atop the base plate 12.

Figure 3:
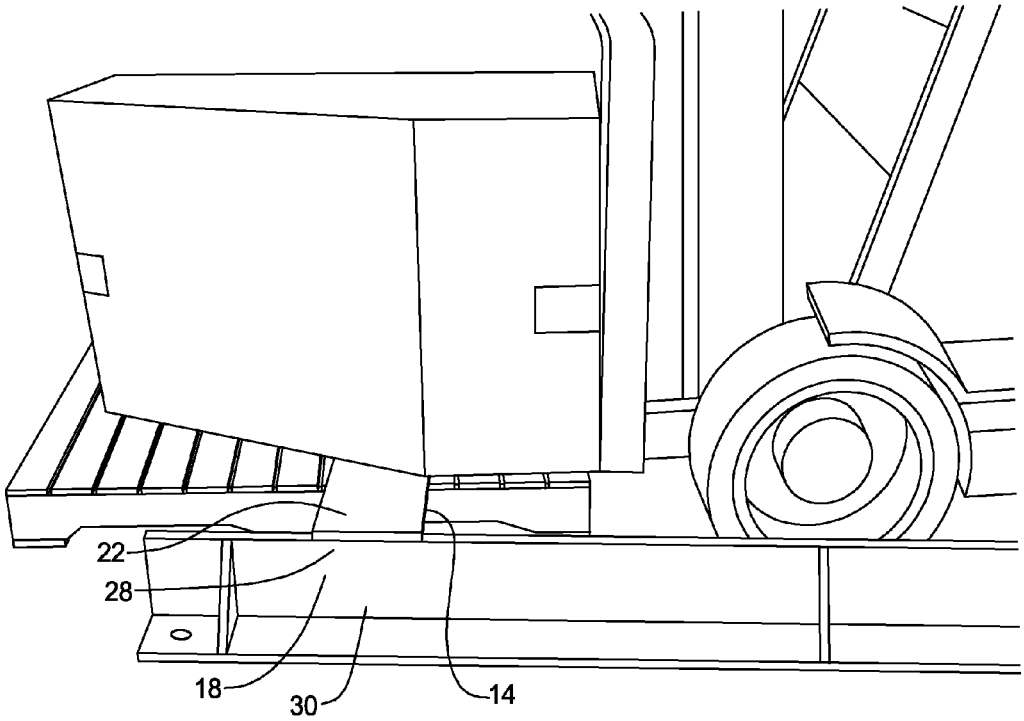
FIG. 3 is a perspective view showing the shearing surface being forced between the dunnage and the pallet.
Figure 4:
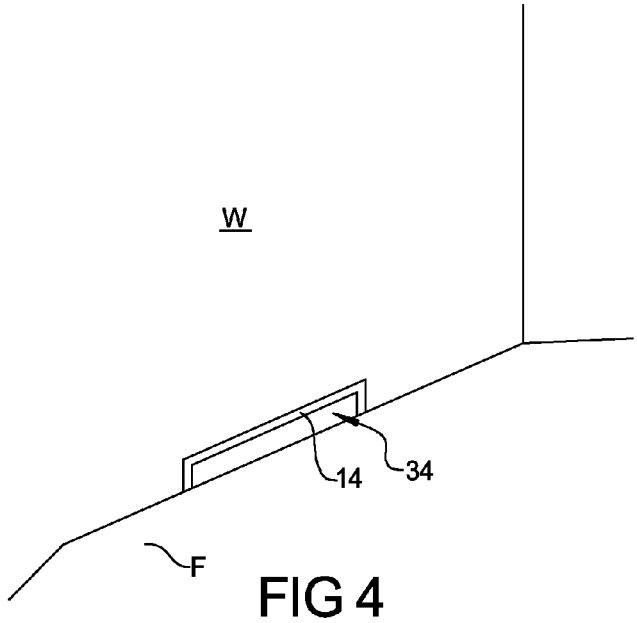
FIG. 4 is a perspective view of an alternative embodiment wherein the shearing surface is a substantially vertical surface for crushing the dunnage against.

The apparatus 10 also includes a shearing surface 14 positioned above the base plate 12. The shearing surface 14 includes a bottom edge 16 which is substantially planar with the base plate 12. The bottom edge 16 of the shearing surface 14 is preferably positioned at a predetermined distance above the base plate 12 to accommodate typical sizes of pallets. For instance, the distance is preferably about 6". The shearing surface 14 functions to separate the dunnage D from the pallet P. The shearing surface 14 accomplishes this by either being forced between the dunnage D and the pallet P to physically separate the two (as shown in FIG. 3), or alternatively by comprising a substantially vertical surface which the dunnage D is pressed, or crushed, against during the operation (as shown in FIG. 4). Preferably, the shearing surface 14 is a leading surface of an elongated rectangular bar 22, although any suitable structure as understood by one having ordinary skill in the art can be used which can interfit between the dunnage D and the pallet P or otherwise operate to separate the dunnage D from the pallet P as the pallet P is forced through an opening 34. When the shearing surface 14 includes an elongated bar 22, the elongated bar 22 has opposed ends 24,24' which are secured to the apparatus 10 as described in further detail below. Preferably the shearing surface 14 is about 60" long to accommodate for any typically-used size of pallet P.

Alternatively, and as mentioned above and shown in FIG. 4, the shearing surface 14 can be formed from a surface which acts as a crushing barrier, such as a wall W. According to this arrangement, as the pallet P is being forced through the opening 34 below, the dunnage D is crushed against the wedge, wall, or similar structure, and the dunnage D is thereby separated from the pallet P. Dunnage D being separated from the pallet P via crushing is shown also in FIG. 7.

Figure 5:
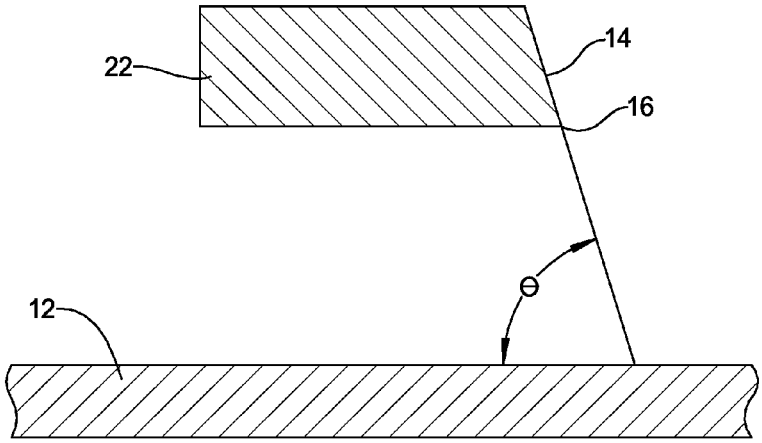
FIG. 5 is a sectional side view showing the shearing surface being oriented at an angle with respect to the base plate.

As shown in FIG. 5, the shearing surface 14 can be oriented at any reasonable angle θ with respect to the base plate 12, for instance, to form a sharp edge, beveled edge, or blunt face. It is believed that a beveled edge is advantageous over a blunt face when the shearing surface 14 is designed to fit between the dunnage D and the pallet P, such as with the elongated bar 22 described above. It is also known that a sharp edge is unsafe for use in many applications, and is also likely in violation of work safety regulations without the proper guards in place. Therefore, the shearing surface 14 is preferably oriented at an angle θ of about 60°-85° with respect to the base plate 12.

The apparatus 10 further includes means for securing 18 the shearing surface 14 to the base plate 12. The means for securing 18 can comprise any suitable type of structure for use herewith which is well-known to one having ordinary skill in the art, including a bar, frame, rod, wall, and so forth. Preferably, the means for securing 18 comprises a pair of substantially vertical plates 26,26', or connector plates. Each vertical plate 26 includes an upper portion 28 and a lower portion 30, and each vertical plate 26 is associated with a respective end 24,24' of the bar 22. The upper portion 28 of each plate 26 is secured to a respective end 24 of the shearing surface 14, and the lower portion 30 of each plate 26 is secured to a respective side 20 of the base plate 12. Each vertical plate 26 is secured to the base plate 12 and the shearing surface 14 using means which are well-known in the art, such as nuts and bolts, brackets, and so forth. Preferably, each vertical plate 26 is welded to both the base plate 12 and the shearing surface 14.

The shearing surface 14 and the means for securing 18 can comprise any suitable material which is well-known to one having ordinary skill in the art. Preferably the shearing surface 14 and the means for securing 18 are formed from metal. Even more preferably, each is formed from a suitable 1" thick steel alloy.

The base plate 12, the shearing surface 14, and the means for securing 18 define the opening 34 through which a pallet P can be forced.

Optionally, the apparatus 10 can include a pair of guide rails 32,32' to guide the entry of the pallet P as it approaches the opening 34.

According to a second aspect of the present invention, there is provided a method for separating the dunnage D from the pallet P including the steps of: (a) providing the apparatus 10 including the base plate 12, the shearing surface 14 positioned above the base plate 12, and an opening 34 defined between the base plate 12 and the shearing surface 14; and (b) forcing the pallet P through the opening 34, whereby the shearing surface 14 separates the dunnage D from the pallet P as the pallet P is forced through the opening 34.

Figure 6:
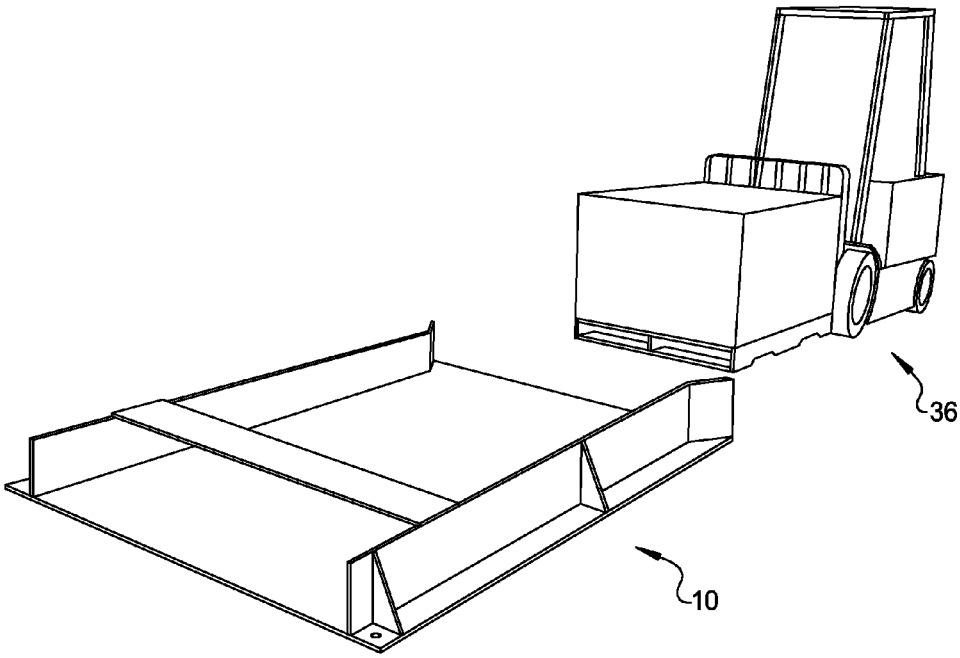
FIG. 6 is a perspective view showing a forklift engaging the pallet and dunnage as it approaches the apparatus.
Figure 7:
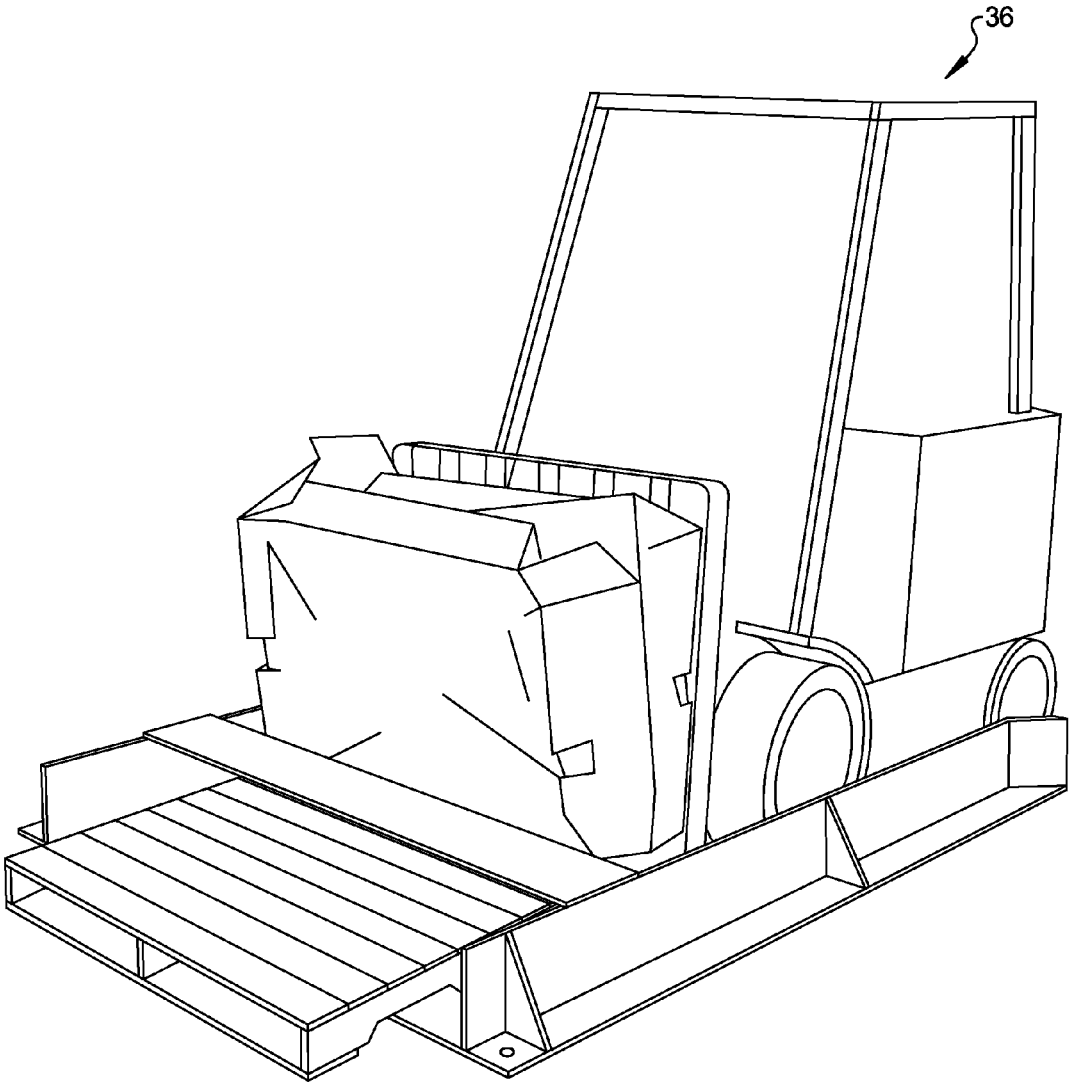
FIG. 7 shows a forklift separating the dunnage from the pallet by passing the pallet through the opening as the dunnage is crushed against the shearing surface.

As shown in FIGS. 3, 6, and 7, this method can optionally include the use of a forklift 36 to provide the necessary power to force the pallet P through the opening 34. Thus, the method can further include the steps of: (1) providing a forklift 36 having forks; (2) engaging the pallet P with the forks of the forklift 36; (3) driving the forklift 36 at least partially onto the base plate 12; (4) vertically positioning the forks to allow the pallet P to pass through the opening 34; and (5) continuing to drive the forklift 36 forward atop the base plate 12 to force the pallet P through the opening 34, thereby using the shearing surface 14 to separate the dunnage D from the pallet P.

It is to be understood that the weight of the forklift 36 atop the base plate 12 restricts the shearing surface 14 from moving when the pallet P is forced through the opening 34 by the forklift 36. Although it is not necessary, the apparatus 10 can be secured to the floor F (e.g., using fasteners such as bolts) when desired. For instance, the apparatus 10 can be secured to the floor F when required by company or state safety regulations.

As is apparent from the preceding, the present invention provides an apparatus and method for separating dunnage from a pallet in which the pallet is forced through an opening thereby separating the dunnage from the pallet.

What is claimed is:

1. An apparatus for separating dunnage from a pallet comprising:

a base plate that is positioned on a floor, the base plate being a planar plate having a thickness such that a forklift carrying the pallet and dunnage can drive upon the base plate;

a pair of vertical plates positioned atop the base plate and extending upwardly from the base plate, each vertical plate having an upper portion and a lower portion, the lower portion of each vertical plate being secured to a respective side of the base plate such that the forklift carrying the pallet and dunnage can drive upon the base plate and between the pair of vertical plates; and an elongated bar having a pair of opposed ends, each of the opposed ends being secured to a respective top portion of one of the respective vertical plates such that the elongated bar spans between the vertical plates, the elongated bar having a leading surface that is a shearing surface for shearing the dunnage from the pallet when the pallet is forced under the elongated bar by the forklift.

2. The apparatus of claim 1 wherein the elongated bar, the pair of vertical plates, and the base plate are welded together.

3. The apparatus of claim 2 wherein the pair of vertical plates, the base plate, and the elongated bar each comprises a metal material.

4. The apparatus of claim 3 wherein the shearing surface is oriented at an angle of about 60°-85° with respect to the base plate.

5. The apparatus of claim 2 wherein the shearing surface is oriented at an angle of about 60°-85° with respect to the base plate.

6. The apparatus of claim 2 wherein the elongated bar is about 60 inches in length, and the base plate is about ⅜ inch thick.

7. The apparatus of claim 1 wherein the pair of vertical plates, the base plate, and the elongated bar each comprises a metal material.

8. The apparatus of claim 7 wherein the shearing surface is oriented at an angle of about 60°-85° with respect to the base plate.

9. The apparatus of claim 1 wherein the shearing surface is oriented at an angle of about 60°-85° with respect to the base plate.

10. The apparatus of claim 1 wherein the elongated bar is about 60 inches in length.

11. The apparatus of claim 10 wherein the base plate is about ⅜ inch thick.

12. The apparatus of claim 11 wherein the base plate is about ⅜ inch thick.

* * * * *